US008052010B2

(12) United States Patent
Borra

(10) Patent No.: US 8,052,010 B2
(45) Date of Patent: Nov. 8, 2011

(54) HELICAL COIL DISPENSER FOR VENDING MACHINES AND VENDING MACHINE COMPRISING SUCH DISPENSER

(75) Inventor: Paolo Borra, Busto Arsizio (IT)

(73) Assignee: Damian S.R.L., Castellanza (IT)

( * ) Notice: Subject to any disclaimer, the term of this patent is extended or adjusted under 35 U.S.C. 154(b) by 446 days.

(21) Appl. No.: 12/374,202

(22) PCT Filed: Jul. 17, 2007

(86) PCT No.: PCT/EP2007/057391

§ 371 (c)(1),
(2), (4) Date: Jan. 16, 2009

(87) PCT Pub. No.: WO2008/009688

PCT Pub. Date: Jan. 24, 2008

(65) Prior Publication Data

US 2009/0283539 A1 Nov. 19, 2009

(30) Foreign Application Priority Data

Jul. 21, 2006 (EP) ..... 06425512

(51) Int. Cl.
*G07F 11/36* (2006.01)

(52) U.S. Cl. ..... 221/124; 221/241

(58) Field of Classification Search ..... 221/75, 221/241, 114, 124, 130; 211/59.2–59.4
See application file for complete search history.

(56) References Cited

U.S. PATENT DOCUMENTS

| | | | | |
|---|---|---|---|---|
| 149,653 | A | 4/1874 | Hallock | |
| 4,149,653 | A | 4/1979 | Lennartson | |
| 4,469,242 | A | 9/1984 | Costa | |
| 4,744,490 | A * | 5/1988 | Albright et al. | 221/75 |
| 4,757,915 | A * | 7/1988 | Albright et al. | 221/75 |
| 4,844,294 | A * | 7/1989 | Albright | 221/75 |
| 4,944,414 | A | 7/1990 | Albright | |
| 5,996,838 | A * | 12/1999 | Bayer et al. | 221/75 |
| 6,902,083 | B1 * | 6/2005 | Michael et al. | 221/75 |
| 7,404,501 | B2 * | 7/2008 | Kelly | 221/241 |

* cited by examiner

*Primary Examiner* — Mark A Deuble
(74) *Attorney, Agent, or Firm* — Pearne & Gordon LLP

(57) ABSTRACT

The present invention relates to a helical coil dispenser (4) for vending machines, which dispenser comprises a frame (5), a plurality of helical coils (6) mounted on the frame (5) and a plurality of motors (15), each connected to a respective helical coil (6), to determine rotation of the helical coil (6) about a longitudinal axis (X) and moving forward of the goods (P) supported by the helical coil (6). The dispenser (4) further comprises adjusting means (18) interposed between each motor (15) and the frame (5), said adjusting means (18) enabling shifting of the motors (15) along a rear side (12) of the frame (5) perpendicular to the longitudinal axes (X) and locking of said motors (15) onto the frame (5), to allow installation of a different number of motors (15) and helical coils (6) and/or installation of helical coils (6) of different sizes.

15 Claims, 5 Drawing Sheets

HELICAL COIL DISPENSER FOR VENDING MACHINES AND VENDING MACHINE COMPRISING SUCH DISPENSER

The present invention relates to a dispenser or drawer of the helical coil type for vending machines and to a vending machine comprising such a device.

Typically, but not necessarily, the present invention applies to the sector of dispensing food products in public places, for example.

It is known that the machines for automatically dispensing goods, commonly known as "vending machines" comprise a box-shaped holding structure internally confining a space adapted to receive the goods intended for sale.

Said goods are disposed in a magazine made up of a plurality of shelves or drawers on each of which helical coils are mounted that are parallel to each other. Housed between the turns of each helical coil are the goods for sale.

The user selects the desired article on sale by pushing a key or keystroking the digital code relating to the article of interest, by means of a keyboard suitably provided on the box-shaped structure.

Each of the helical coils is connected to a motor that, upon operation of the push-button panel causes rotation of said helical coil about a longitudinal extension axis thereof, causing moving forward of the goods housed in the turns and resting on the shelf. As the goods reach the final end of the helical coil, they are pushed beyond an end edge of the shelf and is dropped on a lower portion of the machine. A door formed in said lower portion of the box-shaped structure enables picking-up of the selected article by the user.

In machines of known type, the tray or drawer has a base wall on which the goods and helical coils rest, a bottom wall, opposite to the end edge of the shelf, and two side walls.

The bottom wall is provided with suitable openings through which the motors moving the helical coils are engaged.

To guide the goods during their forward movement imposed by the helical coil rotation, the machine is further provided with partitions extending parallel to the longitudinal extension axes and separating two adjacent helical coils.

It is known that these vending machines must be loaded with several different goods, to differentiate the offer and meet the requirements of a great number of purchasers.

To this end, one individual shelf must be able to simultaneously receive goods contained in packages of different shapes and sizes. In particular, different helical coils lying on the same shelf must contain goods of different sizes. Therefore helical coils of different diameters and pitches are adopted, which will be adapted to receive the packages of different bulkiness to be supplied.

In addition, the number and position of the helical coils intended for a given type of goods are not always the same but it is necessary to be able to vary them based on the purchasers' liking, i.e. the consumer acceptance.

Adaptation of the machine to the type of goods to be sold is obtained in known machines by replacement of the drawers with others having motors and helical coils that are different in number, size and position. Replacement is rather simple but in this case construction of special drawers or availability of a number of trays in excess is required, which adversely affects the purchase and management costs of the machine.

Alternatively, machines are known in which the drawers can be modified although in a very limited manner. In some types of vending machines in fact it is possible to eliminate one side wall thus obtaining a single compartment of double width instead of the two original compartments. In other words, in the presence of articles requiring more room than that ensured by the helical coil and side walls, one of said side walls can be removed so that a double space can be obtained for the particular article (but in this case also one shelf is missing in the drawer).

It should be noted however that this solution does not allow optimisation of the machine performance, although the machine is made more flexible.

In fact, in the presence of an article that is even slightly bulkier than the place laterally available, the only possible solution is to double the width of the delivery channel.

Likewise, in case of articles of reduced bulkiness only part of the available room in the drawer is utilised and consequently part of the volume useful for dispensing the goods is wasted.

In addition, under some particular situations it is necessary to disassemble the motor and remove it for reassembling it to a different position that at all events has been defined a priori; in fact all connections provided for motor and helical coils are pre-set as regards number and position.

Accordingly, it is an aim of the present invention to eliminate the above mentioned drawbacks by proposing a dispenser of the helical coil type for vending machines enabling easy adaptation of the machine on which it is installed to a great number of shapes and sizes of the goods to be sold.

In particular, it is an aim of the present invention to propose a helical coil dispenser enabling the operations required for change of shapes and sizes to be simplified and speeded up as compared with the machines of known type.

It is a further aim of the present invention to conceive a machine enabling reduction in times and costs for the machine management, in particular as far as changes of sizes and shapes are concerned.

The foregoing and further aims are substantially achieved by a helical coil dispenser for vending machines and by a vending machine including such a dispenser, comprising the features set out in one or more of the appended claims.

Description of a preferred embodiment of a vending machine is now given hereinafter by way of non-limiting example, with reference to the accompanying drawings in which.

Figure 1:
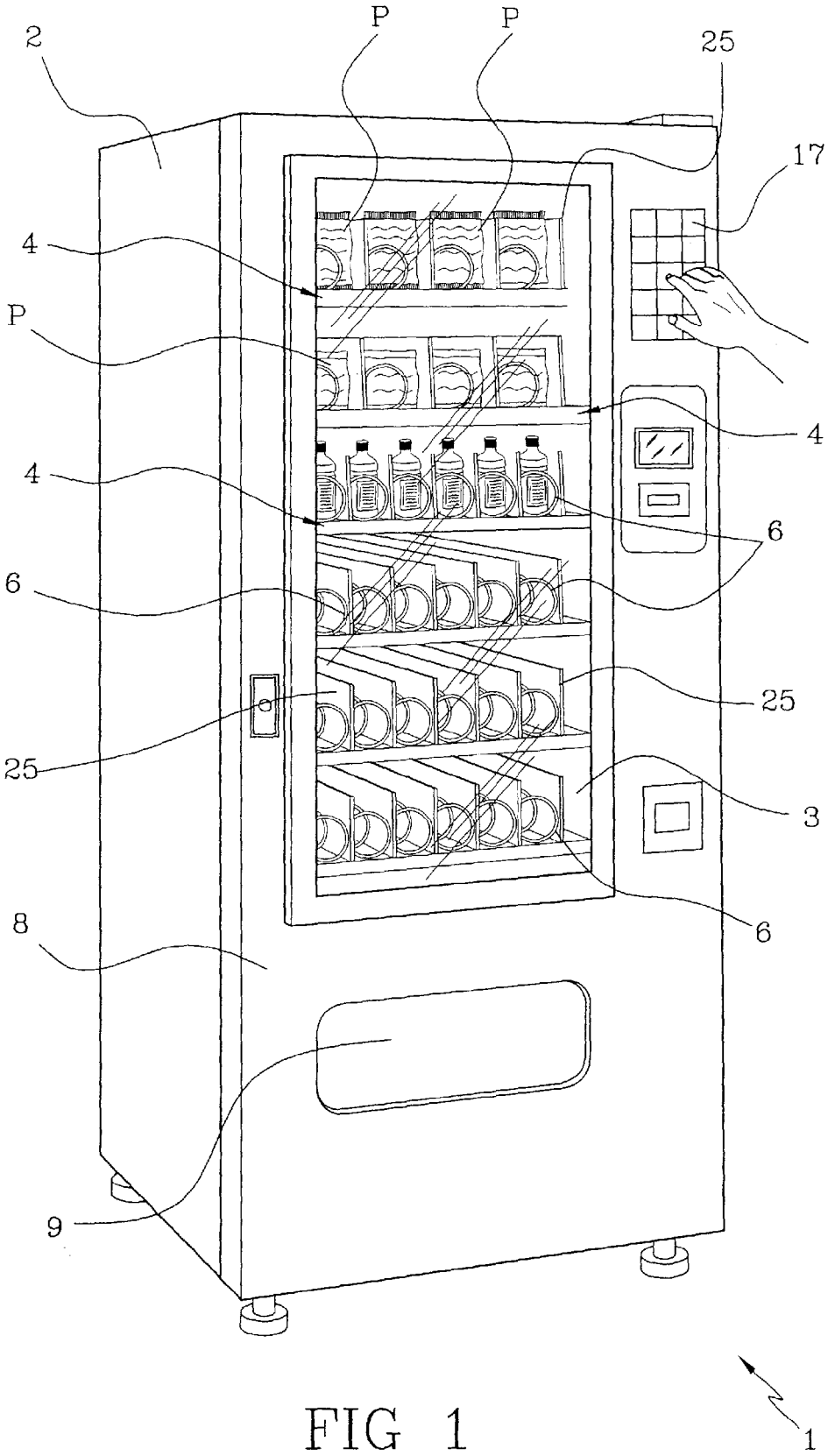
FIG. 1 is a perspective view of a vending machine provided with a dispenser of the helical coil type, in accordance with the present invention.

With reference to the drawings, a machine for automatically dispensing goods "P", commonly referred to as "vending machine" has been generally denoted by 1.

The machine 1 comprises a box-shaped structure 2 which internally confines a space 3 designed to receive the goods or articles "P" to be sold.

Disposed inside the space 3, upon each other, are dispensing devices or dispensers 4 of the helical coil type, the function of which is to store the goods "P" and carry out handling of them, when selected.

Each of the dispensers 4 comprises (FIGS. 2 and 3) a frame 5 shaped like a tray or a drawer, on which helical coils 6 are mounted the function of which is to contain the goods "P" to be sold within their turns and to feed said goods "P" beyond a peripheral edge 7 of the frame 5, to cause falling of same into a lower portion 8 of the machine 1 where a door or opening 9 allow the user to pick up the selected article "P".

Figure 2:
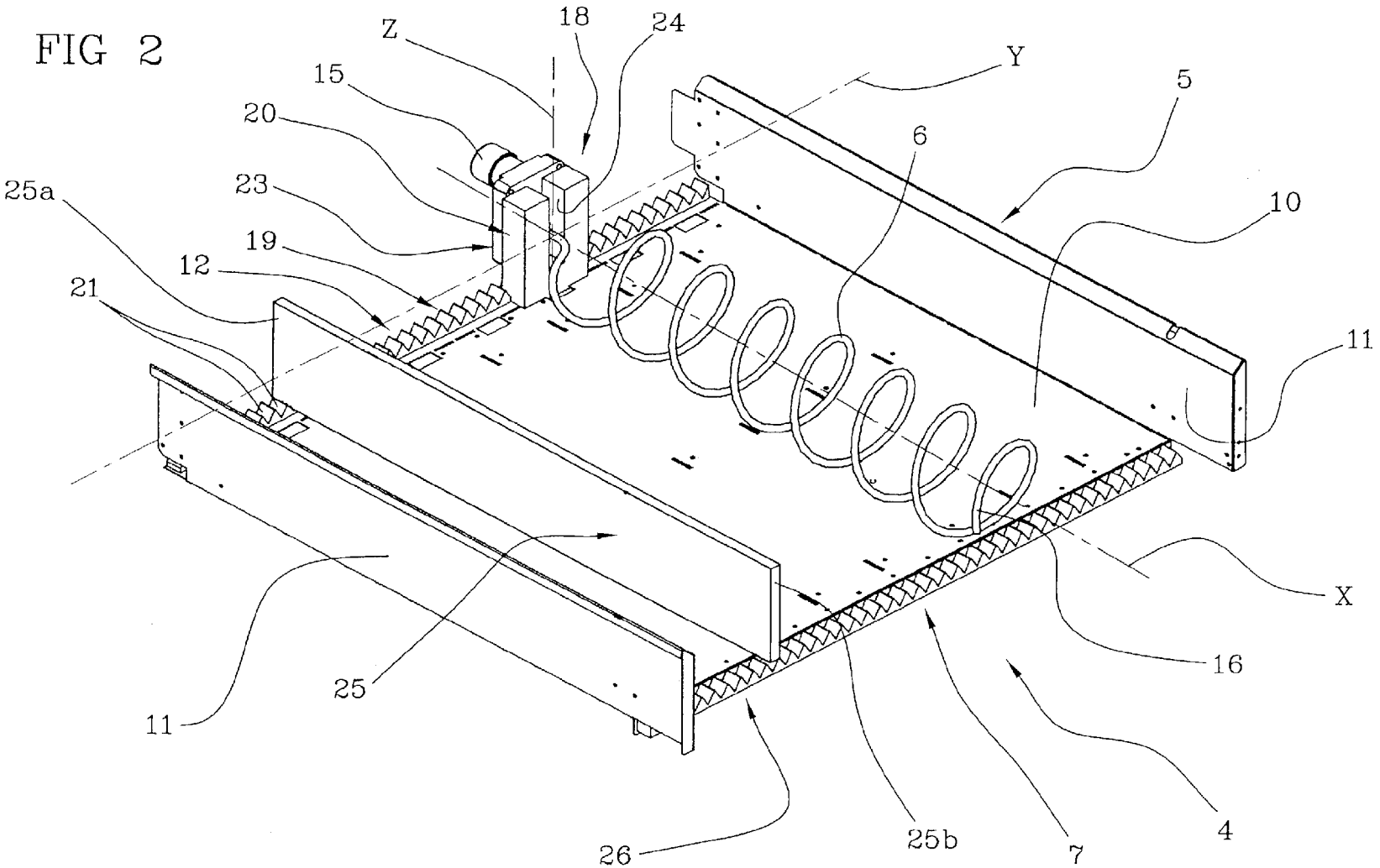
FIG. 2 is a perspective view of one of the helical coil dispensers seen in FIG. 1, with some parts removed for better understanding of others.
Figure 3:
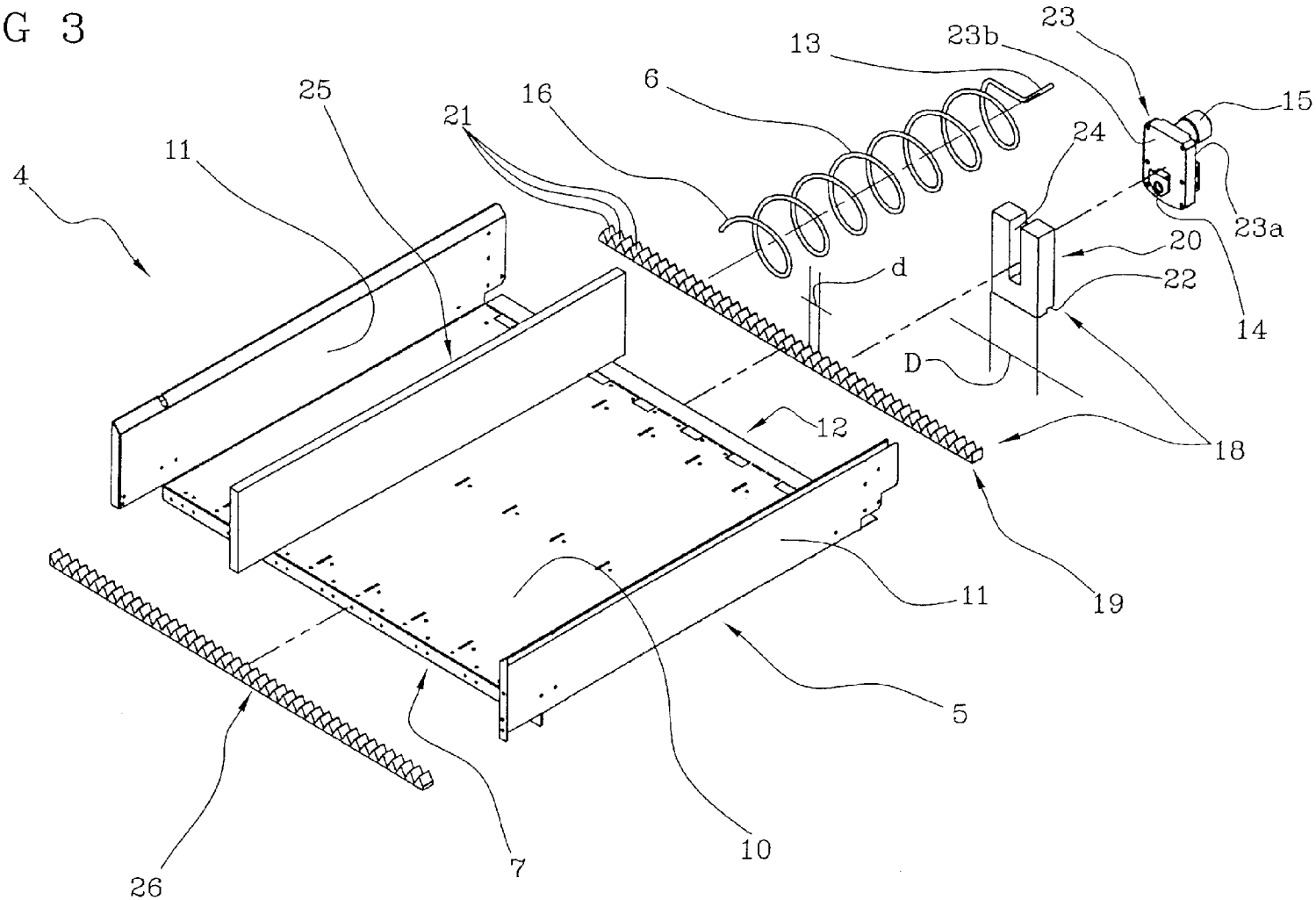
FIG. 3 is an exploded view of the dispenser seen in FIG. 2.
Figure 4:
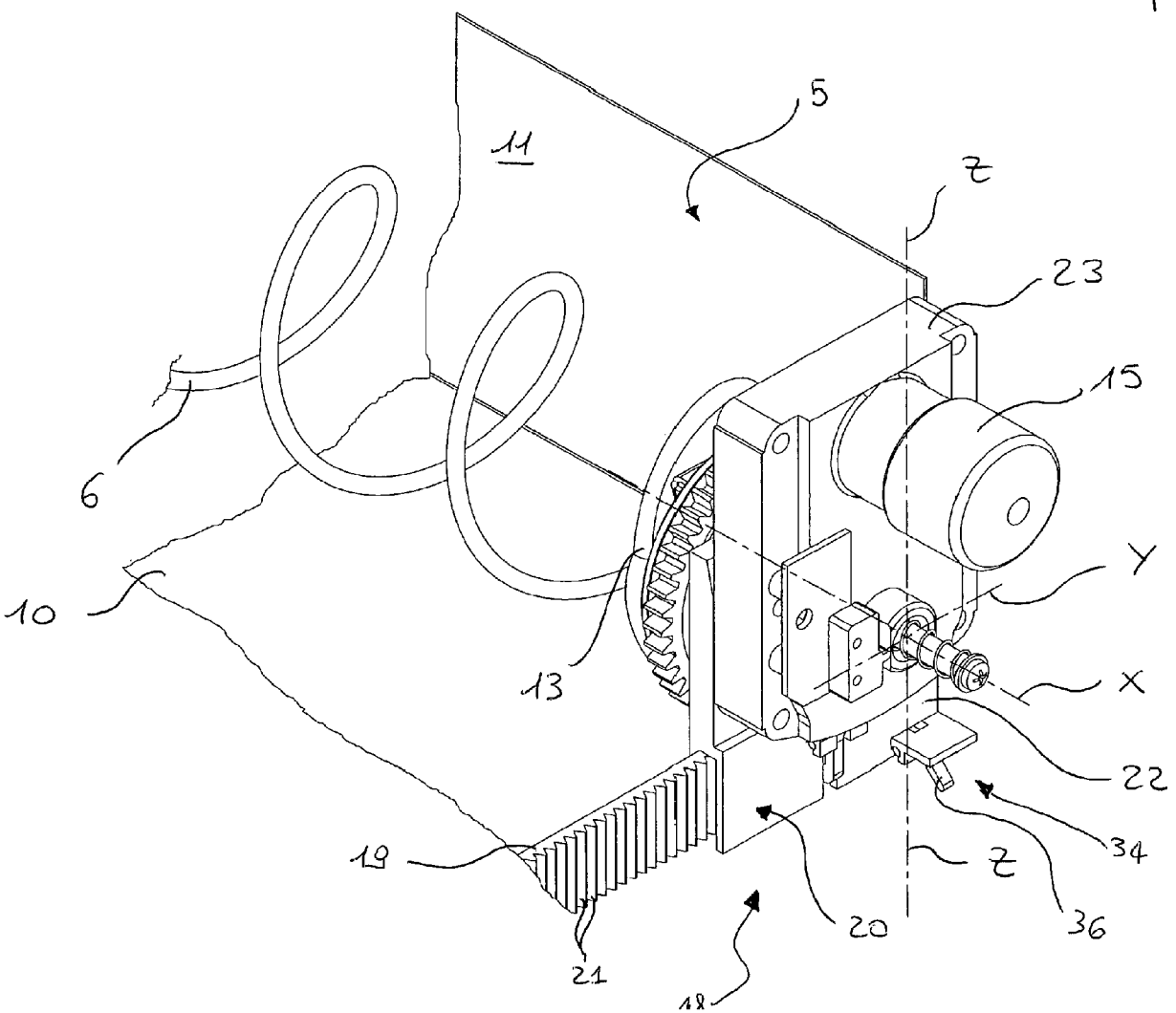
FIG. 4 is an enlarged view of a rear region of the dispenser.

In more detail, with reference to FIGS. 2 and 3, said dispenser 4 comprises a base wall 10, which at the inside of the machine 1 is mounted in a substantially horizontal plane, and two side walls 11 perpendicular to the base wall 10 and disposed along opposite side edges thereof. The base wall 10 of the dispenser 4 has a front side that is coincident with the peripheral edge 7 and a rear side 12 opposite to the front one 7. When the device 4 is installed in the space 3 of the box-shaped structure 2, the side walls 11 lie in side by side relationship with the inner walls of the space 3 itself.

Each of the helical coils 6 extends along an axis "X" having a longitudinal extension and being parallel to the side walls 11 and perpendicular to the peripheral edge 7.

Each proximal end 13 of the helical coil 6 is connected, in the vicinity of the rear side 12, to a shaft 14 of a respective electric motor 15, while a distal end 16 of the helical coil 6 itself terminates in the vicinity the peripheral edge 7 to accompany the goods "P" close to the boundary of the base wall 10.

A mechanical, electro-mechanical or preferably electronic management unit is operatively connected to the motors 15 and to selection means 17, such as a push-button panel, positioned on the box-shaped structure 2.

The user selects the desired article "P" through the push-button panel. The management unit receives the signal from the push-button panel and causes operation of motor 15 and rotation of the respective helical coil 6 containing the selected article "P", around the respective axis "X" causing the selected article "P" to move forward until beyond the peripheral edge 7 and to fall into the above mentioned lower portion 8.

The dispensing device 4 further comprises adjusting means 18 interposed between each motor 15 and the frame 5, which adjusting means 18 enables shifting and repositioning of motors 15 along the rear side 7 of frame 5. This shifting is perpendicular to the longitudinal axes "X" of the helical coils 6.

It is apparent that the adjusting means can be directly formed and be of one piece construction with the motor support or may consist of an element separated from the motor block (provided said means enables adjustment of the position of the motor itself), the two solutions falling within the scope of the inventive idea.

The adjusting means 18 further allows these motors 15 to be locked to the frame 5 to the desired position, so as to enable installation of a different number of motors 15 and helical coils 6 and/or installation of helical coils 6 with different sizes.

Preferably, the adjusting means 18 allows shifting of each motor 15 in a plane perpendicular to the longitudinal axes "X", along a first direction "Y" parallel to the rear side of frame 5 and along a second direction "Z" perpendicular to the first direction "Y" and to said longitudinal axes "X" (FIG. 2).

Shifting of motors 15 along the first direction "Y", i.e. to the right or to the left, allows the goods "P" of different sizes and/or shapes to be loaded into helical coils 6 belonging to the same dispenser 4, using helical coils 6 of different diameter and/or pitch.

Shifting of the motors 15 along the second direction "Z", i.e. upwards or downwards, allows installation of helical coils 6 of different diameter, while preventing the same from interfering with the base wall 10.

Preferably, the adjusting means 18 comprises one guide 19 disposed along the rear side 7 of frame 5 and a plurality of supports 20 to be mounted on the guide 19 and each supporting one of said motors 15. For the sake of clarity, only one support 20 associated with a single helical coil 6 is shown in FIGS. 2 and 3.

The guide 19 can be of the discrete type, i.e. it can comprise a plurality of discrete seats 21 disposed in succession along the rear side 7 of frame 5. Each of the supports 20 has a coupling portion 22 for engagement with said seats 21.

By way of example and therefore not for purposes of limitation, in the accompanying drawings the guide 19 is shaped like a toothing extending along the rear side 12 of the base wall 10 of frame 5.

The coupling portion 22 of the support 20 has a spring tab 30 provided with at least one pawl 31 engaging in the toothing 19 and ensuring precise positioning along the first direction "Y".

By exerting pressure on an operating lever 32, a return element 33 is elastically deformed and disengagement of the pawl 31 from the toothing 19 occurs. In this way free sliding of the support 20 in the direction "Y" is allowed. Once the new positioning for the motor has been found, the operating lever 32 is released and due to the elastic return of the return element 33, the pawl 31 engages the toothing 19 again to a different position so as to lock the support, i.e. to inhibit further side sliding of same.

Figure 5:
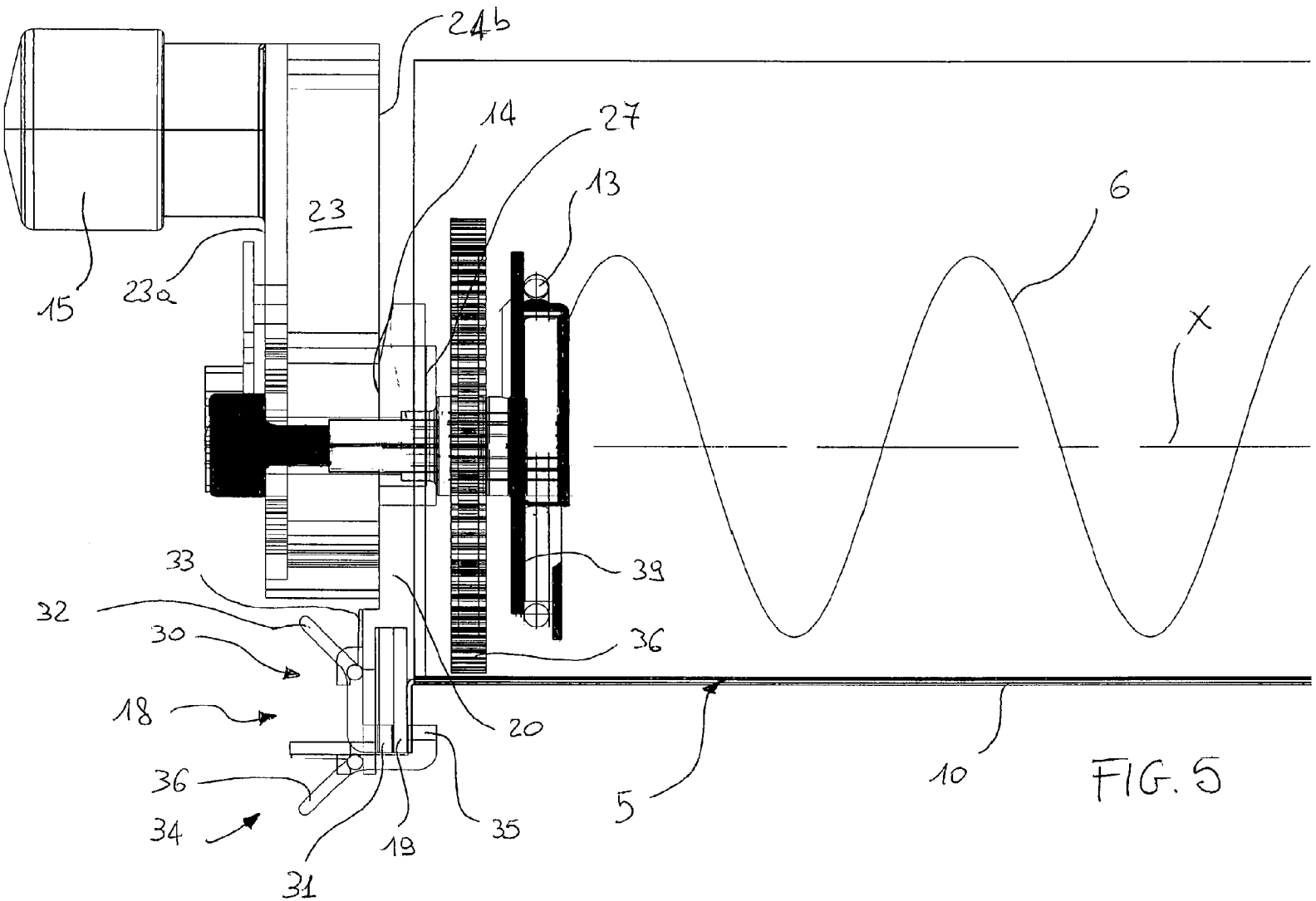
FIG. 5 shows a partial section of the dispenser seen in FIG. 4.

Also shown is a hooking element 34 enabling the support 20 to be secured to frame 5 with freedom of movement in a horizontal direction (axis "Y"). The hooking element 34 has a hooking portion 35 (FIG. 5) adapted to lock the support onto the toothing 19 so that the latter acts as a guide along which the support is movable.

Structure and operation of the hooking element 34 are quite similar to those of the spring tab 30 and therefore will not be further described.

It is well apparent that pressure on the operating lever 36 will allow simple removal of the support 20 from frame 5.

Locking of support the 20 on said toothing 19 can be alternatively obtained by means of screws or clamps (not further described) or at all events by means of any system adapted to ensure junction and to enable easy disengagement of the support 20 from the toothing 19, so that said support can be moved along the first direction "Y" when change of shape and size is required.

The pitch of toothing 19 or, more generally, the distance "d" between the discrete seats 21 must be much smaller than the transverse bulkiness of the supports 20 (measured along the first direction "Y") to enable fine adjustment of the position of said supports 20 along the first direction "Y". Preferably, this distance "d" can be of 1-2 mm.

Alternatively, the guide 19 has an engagement portion extending without a break along the rear side 7 and each of the supports 20 has a coupling portion to be slidably mounted along the engagement portion and adapted to be locked on said engagement portion at any position.

In this case a smooth guide will be present in place of toothing 19 and the support will be engaged therein by the hooking element 34. Then, also provided will be suitable detent means adapted to lock the support to the desired position. Instead of the spring tab 30, it will be possible to lock the support in place, for instance, by suitable screws or elements creating sufficient friction between support 20 and guide 19.

Also adjustable will be the motor position along the second direction "Z" and preferably each of said motors 15 will be able to be mounted on the respective support 20 at different heights.

According to an embodiment not shown, each of motors 15 can be engaged in a plurality of discrete seats formed in the respective support 20 and disposed consecutively along the second direction "Z".

In accordance with an alternative embodiment, each of the motors 15 is slidably shiftable on the respective support 20 along the second direction "Z" and lockable on said support 20 at any position.

Therefore, in the same manner as the adjustment along the first direction "Y", also adjustment along the second direction "Z" can be of the continuous or discrete type. In more detail, the motor 15 shown in FIGS. 2 and 3 is represented to be fixed on a plate 23 which in turn is installed on the support 20. Plate 23 is preferably fastened to support 20 by means of a groove 24 adapted to enable passage of a shaft 14 for motion transmission to the helical coils 6; plate 23 and a counter-surface 37 can be pressure-fitted into the groove or, alternatively, tightened by one or more screws against the support 20 and the position is maintained due to friction generated between the contacting surfaces.

Motor 15 is located on a first face 23*a* of plate 23 opposite to a second face 24*b* of the same plate 23 in engagement with the support 20. The shaft 14 passes through said plate 23 and extends from the second face 23*b*. In addition, as shown in FIGS. 2 and 3, the shaft 14 is offset relative to motor 15 and is coupled with motor 15 by means of a motion-transmitting mechanism.

The support 20 has a U-shaped conformation delimiting the groove 24 oriented along the second direction "Z". When plate 23 is mounted on support 20, the shaft 14 is placed in the groove 24 and keeps a position facing the inside of frame 5 in the form of a drawer, being secured to suitable wheels 36, 39 with a rotation axis coincident with the rotation axis of the helical coil 6. The last wheel 39 receives the proximal end 13 of the helical coil 6 to set it in rotation.

During vertical adjustment of motor 15, the shaft 14 is caused to slide in groove 24, always facing the inside of frame 5.

Preferably, the dispenser 4 further comprises a plurality of partitions 25 to be arranged between the helical coils 6, to separate the goods "P" and prevent them from laterally coming out of the helical coils 6 defining respective compartments in the drawer. Each of the partitions 25 is parallel to the longitudinal axis "X" and the side walls 11 of frame 5 and extends from the rear side 12 of the base wall 10 until preferably the peripheral edge 7 of frame 5.

The partitions 25 too are shiftable along the first direction "Y" so that their number and position can be adapted each time to the number and position of the motors 15 and helical coils 6. In the same manner as adjustment of the supports 20 occurs, partitions 25 too can be adjusted either in a continuous or a discrete manner.

In accordance with one embodiment, each of the partitions 25 is slidably shiftable on frame 5 (along the first direction "Y") and lockable to said frame 5 at any position. Alternatively, each of the partitions 25 can be secured to a plurality of discrete seats 21 defined by a toothing, for example. Preferably, each of the partitions 25 can be secured to frame 5 at a proximal end thereof that can be joined to frame 5 in the region of the rear side 12 of the frame 5 itself.

Preferably, each partition 25 can be further secured to frame 5 at a distal end 25*b* thereof that can be joined to frame 5 in the region of the front side 7 of said frame 5.

In the embodiment shown in FIG. 3, each partition 25 is secured to toothing 19 extending along the rear side 12 of the base wall 10 and has a toothing 26 extending along the front side 7 of the base wall 10.

In detail, a front support 40 similar to support 20 is present. Said support 40 can be secured to the toothing 26 (or to a smooth guide) with freedom of sliding along axis "Y" and can be locked in place by a spring tab of the previously described type (tab 30) or by screws, friction or other similar means.

In a further embodiment, the partitions 25 could also be joined to the supports 20 and be shiftable therewith. As in other known solutions (although less flexible), a single motor 15 can be used to simultaneously move two or more helical coils in a selective manner by merely adopting the suitable (and already known) motion-transmitting means.

The invention reaches the intended purposes and achieves important advantages.

In fact, first of all, the dispenser according to the invention allows adaptation of the number and sizes (pitch and diameter) of the helical coils at choice, based on the type of the goods to be loaded onto a single tray of the machine.

In fact, fine adjustment of each individual support along the first direction "Y" allows the helical coils to be positioned practically everywhere, without being obliged to install them at few predetermined positions. Any distance can exist between the partitions 25 so that compartments of transverse sizes all different from each other can be even defined, depending on requirements. Thus on a single drawer, sets of helical coils with different sizes can be simultaneously mounted.

In addition, the device of the invention allows this adaptation to be carried out in a simple and quick manner, without disassembling parts of the machine and/or replacing drawers. Therefore, the adaptation operations can be executed by non-qualified staff only having a superficial knowledge of the machine.

Finally, since it is no longer necessary to use different drawers to be replaced each time, the manufacture and management costs of the machine are reduced as compared with the machines of known type. In fact, with a reduced number of components it is possible to manufacture a great number of different drawers substantially suitable for any requirement, be they standard or special drawers.

In addition, should the destination of use of a machine be modified, it will be possible to adjust again the different components without needing full replacement of the drawer, which event presently occurs.

The invention claimed is:

1. A helical coil dispenser for vending machines, comprising:

a frame;

a plurality of helical coils mounted on the frame and each extending along a longitudinal extension axis thereof;

each helical coil being coupled to a respective motor designed to determine a rotation of the helical coil about said longitudinal extension axis causing moving forward of goods supported by said helical coil;

wherein the helical coil dispenser further comprises adjusting means interposed between each motor and the frame, said adjusting means comprising a plurality of supports, each supporting one motor, and a guide disposed on the frame; said supports being mounted on said guide and being designed to translate along about throughout said guide in a first direction perpendicular to the longitudinal extension axes and parallel to a main development of a rear side of the frame; said supports and said guide being designed to allow each support, during its translation, to reach a plurality of stable positions along the guide, so as to lock of said motors to a plurality of different positions on the frame, to enable installation of a different number of motors and helical coils or installation of helical coils of different sizes.

2. A dispenser as claimed in claim 1, wherein the adjusting means enables shifting of each motor in a second direction perpendicular to the longitudinal extension axes and to said first direction.

3. A dispenser as claimed in claim 1, wherein the supports are of one piece construction with, or separated from the respective motor.

4. A dispenser as claimed in claim 1, wherein the guide comprises a plurality of discrete seats disposed in succession along the rear side of the frame and each of the supports has a coupling portion to be secured to said seats.

5. A dispenser as claimed in claim 1, wherein the guide comprises a toothing extending along the rear side of the frame; said toothing having a pitch much smaller than a transverse bulkiness of the support.

6. A dispenser as claimed in claim 1, wherein the guide has an engagement portion extending without a break along the rear side of the frame and each of the supports has a coupling portion to be slidably mounted along the engagement portion and lockable to said engagement portion.

7. A dispenser as claimed in claim 2, wherein each of the motors is slidably shiftable on the respective support along the second direction and lockable onto said support.

8. A dispenser as claimed in claim 2, wherein each of the motors can be secured to a plurality of discrete seats formed on the respective support and disposed consecutively along the second direction.

9. A dispenser as claimed in claim 1, further comprising a plurality of partitions adapted to be disposed between the helical coils; said partitions being designed to translate along said first direction.

10. A dispenser as claimed in claim 9, wherein each of the partitions is designed to be locked onto said frame.

11. A dispenser as claimed in claim 9, wherein each of the partitions is designed to be secured to a plurality of discrete seats placed in succession along the first direction.

12. A dispenser as claimed in claim 9, wherein each of the partitions is designed to be secured to the frame at a proximal end thereof designed to be joined to the frame in the region of the rear side of said frame.

13. A dispenser as claimed in claim 9, wherein each of the partitions is designed to be secured to the frame at a distal end thereof designed to be joined to the frame in the region of a front side of said frame, opposite to the rear side.

14. A helical coil dispenser for vending machines, comprising: a frame; a plurality of helical coils mounted on the frame and each extending along a longitudinal extension axis thereof; a plurality of motors, each connected to a respective helical coil to determine rotation of the helical coil about its longitudinal axis and moving forward of the goods supported by said helical coil; wherein the helical dispenser further comprises adjusting means interposed between each motor and the frame, said adjusting means allowing shifting of the motors along a rear side of the frame perpendicular to the longitudinal axes and locking of said motors to a plurality of different positions on the frame, to enable installation of a different number of motors and helical coils or installation of helical coils of different sizes; the adjusting means comprising a guide disposed along the rear side of the frame and a plurality of supports to be mounted on the guide and each supporting one of said motors; the guide having an engagement portion extending without a break along the rear side of the frame and each of the supports having a coupling portion to be slidably mounted along the engagement portion and lockable to said engagement portion.

15. A helical coil dispenser for vending machines, comprising: a frame; a plurality of helical coins mounted on the frame and each extending along a longitudinal extension axis thereof; a plurality of motors, each connected to a respective helical coil to determine rotation of the helical coil about its longitudinal axis and moving forward of the goods supported by said helical coil; wherein the helical dispenser further comprises adjusting means interposed between each motor and the frame, said adjusting means allowing shifting of the motors along a first direction parallel to a rear side of the frame, which is perpendicular to the longitudinal axes, and locking of said motors to a plurality of different positions on the frame, to enable installation of a different number of motors and helical coils or installation of helical coils of different sizes; the adjusting means comprising a guide disposed along the rear side of the frame and a plurality of supports to be mounted on the guide and each supporting one of said motors; each of the motors being designed to be secured to a plurality of discrete seats formed on the respective support and disposed consecutively along a second direction perpendicular to both said first direction and said longitudinal extension axis.

* * * * *

UNITED STATES PATENT AND TRADEMARK OFFICE

CERTIFICATE OF CORRECTION

PATENT NO. : 8,052,010 B2
APPLICATION NO. : 12/374202
DATED : November 8, 2011
INVENTOR(S) : Paolo Borra It is certified that error appears in the above-identified patent and that said Letters Patent is hereby corrected as shown below:

In column number 8, line number 23, in line 2 of Claim 15, please delete:

"helical coins"

and insert therefor

--helical coils--.

Signed and Sealed this
Third Day of January, 2012

David J. Kappos

David J. Kappos
*Director of the United States Patent and Trademark Office*